US005829610A

United States Patent [19]

Rohr et al.

[11] Patent Number: 5,829,610

[45] **Date of Patent: *Nov. 3, 1998**

[54] CLOSURE WITH A TAMPER-INDICATING ELEMENT OPTIONALLY SUITABLE FOR USE AS A TOOL

[75] Inventors: Robert D. Rohr, Eagle, Wis.; Leo R. Imbery, Jr., North Aurora, Ill.

[73] Assignee: AptarGroup, Inc., Crystal Lake, Ill.

[ * ] Notice: The term of this patent shall not extend beyond the expiration date of Pat. No. 5,462,183.

[21] Appl. No.: 712,551

[22] Filed: Sep. 13, 1996

[51] Int. Cl.[6] ..... B65D 43/00

[52] U.S. Cl. ..... 215/250; 215/237; 215/901; 220/263; 220/265; 220/324; 220/DIG. 34

[58] Field of Search ..... 220/DIG. 34, 255, 220/256, 259, 260, 263, 265, 337, 334, 262, 277, 284, 324; 215/201, 224, 235–242, 250, 901, 230, 228

[56] References Cited

U.S. PATENT DOCUMENTS

| | | | |
|---|---|---|---|
| 3,117,703 | 1/1964 | Henchert . | |
| 3,135,441 | 6/1964 | Wise et al. . | |
| 3,160,327 | 12/1964 | Porcelli . | |
| 3,239,112 | 3/1966 | Porcelli . | |
| 3,255,915 | 6/1966 | Scholtz . | |
| 3,255,928 | 6/1966 | Foster . | |
| 3,278,089 | 10/1966 | Heekin et al. . | |
| 3,282,477 | 11/1966 | Henchert . | |
| 3,458,080 | 7/1969 | Lauricio . | |
| 3,495,746 | 2/1970 | Lauricio . | |
| 3,604,585 | 9/1971 | Towns . | |
| 3,651,992 | 3/1972 | Hazard . | |
| 3,708,083 | 1/1973 | Gronemeyer et al. . | |
| 3,744,682 | 7/1973 | Blank . | |
| 3,788,549 | 1/1974 | Ostrowsky . | |
| 3,825,110 | 7/1974 | Halbich et al. | 220/324 X |
| 3,873,006 | 3/1975 | Fields . | |
| 3,881,638 | 5/1975 | Grothoff . | |
| 3,966,080 | 6/1976 | Bittel . | |
| 4,047,643 | 9/1977 | Hazard . | |
| 4,067,482 | 1/1978 | Vogel et al. . | |
| 4,127,221 | 11/1978 | Vere . | |
| 4,129,226 | 12/1978 | Percival . | |
| 4,170,315 | 10/1979 | Dubach et al. . | |
| 4,344,545 | 8/1982 | Aschberger et al. . | |
| 4,353,483 | 10/1982 | Pehr . | |
| 4,361,244 | 11/1982 | Walter . | |
| 4,361,250 | 11/1982 | Foster . | |
| 4,371,088 | 2/1983 | Gach . | |
| 4,378,073 | 3/1983 | Luker . | |
| 4,397,400 | 8/1983 | Walter . | |
| 4,403,712 | 9/1983 | Wiesinger | 220/339 X |
| 4,407,423 | 10/1983 | Walter . | |
| 4,431,110 | 2/1984 | Roth . | |
| 4,460,100 | 7/1984 | Libit . | |
| 4,462,504 | 7/1984 | Roth et al. . | |
| 4,463,869 | 8/1984 | Lewis . | |
| 4,467,931 | 8/1984 | Gach . | |
| 4,487,324 | 12/1984 | Ostrowsky . | |
| 4,519,517 | 5/1985 | Walter . | |

(List continued on next page.)

FOREIGN PATENT DOCUMENTS

| | | |
|---|---|---|
| 1333334 | 10/1973 | United Kingdom . |

*Primary Examiner*—Stephen K. Cronin
*Assistant Examiner*—Robin A. Hylton
*Attorney, Agent, or Firm*—Rockey, Milnamow & Katz, Ltd.

[57] ABSTRACT

A tamper-evident closure is provided with a base for attachment to a container, and the base defines a discharge aperture. A lid is movable between a closed position and an open position with respect to the discharge aperture. A manually releasable latch holds the lid closed on the base. A tamper-indicating element is mounted adjacent the latch. In one form of the invention, the element has a removable part defining a tool. According to another aspect of the invention, the removable part of the element is broken away when the latch is operated. In yet another form of the invention, the element prevents operation of the latch until the removable part of the element is first removed.

19 Claims, 8 Drawing Sheets

U.S. PATENT DOCUMENTS 4,592,480 6/1986 Hart et al. .
4,595,123 6/1986 Libit .
4,610,371 9/1986 Karkiewicz .
4,621,744 11/1986 Foster .
4,658,980 4/1987 Lindstrom .
4,682,702 7/1987 Gach .
4,696,408 9/1987 Dubach .
4,711,363 12/1987 Mariso .
4,711,372 12/1987 Gach .
4,711,380 12/1987 Ulm .
4,733,787 3/1988 Knopf et al. .
4,736,858 4/1988 Shastal .
4,763,801 8/1988 Nyez .
4,775,065 10/1988 Shastal .
4,778,070 10/1988 Walker .
4,778,072 10/1988 Newman .
4,779,766 10/1988 Kinsley .
4,782,964 11/1988 Poore et al. .
4,795,044 1/1989 Beck .
4,796,769 1/1989 Obadia .
4,807,769 2/1989 Gach .
4,809,874 3/1989 Pehr .
4,869,399 9/1989 Dubach .
4,892,217 1/1990 Shastal .
4,901,892 2/1990 Song .
4,938,390 7/1990 Markva .
4,941,592 7/1990 Kitterman .
4,948,003 8/1990 Munoz .
4,969,574 11/1990 Shatal .
4,974,735 12/1990 Newell et al. ..... 215/250 X
4,984,700 1/1991 Knickerbocker ..... 215/250 X
4,984,716 1/1991 Beck .
5,052,572 10/1991 Pherigo .
5,058,775 10/1991 Gross et al. .
5,069,367 12/1991 Salmon et al. .
5,094,361 3/1992 Dubach ..... 220/277 X
5,123,561 6/1992 Gross .
5,147,054 9/1992 Pehr .
5,158,197 10/1992 Richter et al. .
5,197,618 3/1993 Goth .
5,199,618 4/1993 Reil et al. .
5,201,440 4/1993 Gross .
5,213,235 5/1993 Miranda .
5,255,812 10/1993 Hsu ..... 215/228 X
5,271,519 12/1993 Adams et al. .
5,356,017 10/1994 Rohr et al. .
5,356,018 10/1994 Dubach ..... 220/265 X
5,462,183 10/1995 Rohr et al. .

104
106
108
110
112
114
116
120
144
150
102
109
54
55
56
58
50
60
26
24
20
132
6
70
74
78
81
86

FIG. 14
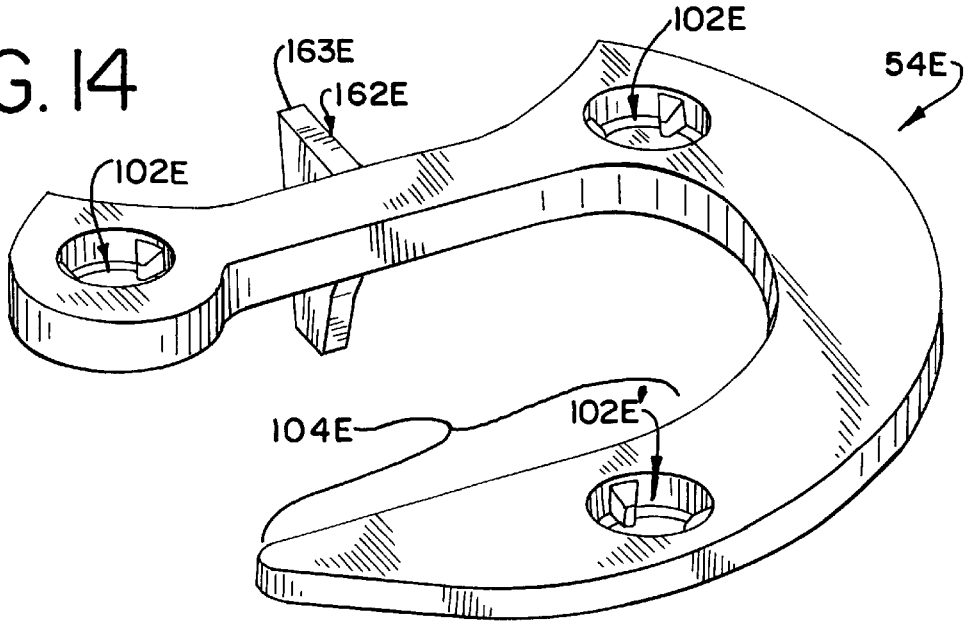
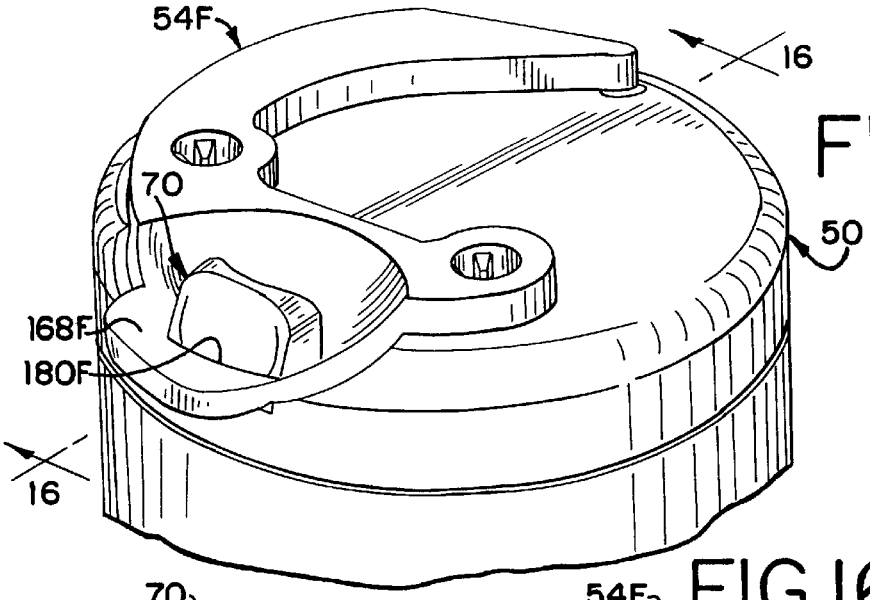
FIG.15
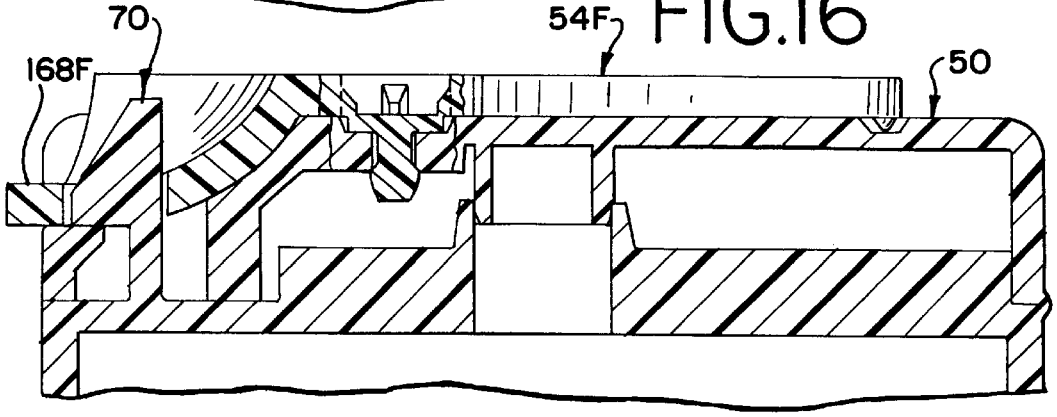
FIG.16

CLOSURE WITH A TAMPER-INDICATING ELEMENT OPTIONALLY SUITABLE FOR USE AS A TOOL

TECHNICAL FIELD

This invention relates to a tamper-evident closure for a container.

BACKGROUND OF THE INVENTION AND TECHNICAL PROBLEMS POSED BY THE PRIOR ART

Designs have been proposed for container closures which include a latch for holding the closure closed and preventing the opening of the closure unless the closure latch is manipulated in a specific manner.

Some such designs are particularly suitable for use as child-resistant closures.

The U.S. Pat. No. 5,462,183 discloses a closure having a child-resistant latch and a tamper-evident element. The closure has a base or body adapted to be mounted on the container over the opening and has a deck defining a discharge aperture through which the container contents can be dispensed. The latch includes a resilient locking member in the form of a lever projecting upwardly from the closure body.

A lid is hingedly connected to the body for movement between a closed position occluding the discharge aperture in an open position spaced from the discharge aperture. The lid defines an aperture for receiving the lever when the lid is closed so that the lever engages an adjacent portion of the lid and holds the lid closed.

In order to open the closure, the lever must be pushed in one direction while the lid is lifted. However, before this can be done, a tamper-indicating element must be removed. The element is attached to lid with frangible portions which can be broken when sufficient force is applied to remove at least a part of the element and permit operation of the lever. An anchor portion of the tamper-indicating element remains on the lid to provide evidence that part of the element has been removed.

While the above-discussed closure functions well in the applications for which it has been designed, it would be desirable to provide a tamper-indicating closure with additional or other features that would be desirable in some applications. In particular, it would be beneficial to provide a tamper-indicating closure in which the action of releasing the latch with sufficient force would simultaneously effect the breaking of the tamper-indicating element. Further, it would be advantageous if the tamper-indicating element could include a removable portion for optionally serving as a tool for piercing a seal in the closure or container and/or for snagging and removing packing material from the container.

Additionally, it would be desirable if such a closure presented an upper surface that permits stacking.

Also, it would be advantageous if the tamper-indicating element could accommodate designs permitting the contouring of the underside of the element to correspond to, or accommodate, the particular shape of the closure lid.

Further, it would be desirable if such a tamper-indicating element functioned in an effective and simple manner so as to easily break as intended when the closure locking lever is first moved to a release position. Preferably, an anchor portion of the tamper-indicating element remaining on the lid should provide readily observable evidence of removal of the broken away part.

Further, it would be beneficial if such an improved tamper-indicating closure design could be readily employed with various types of child-resistant closures as well as non-child-resistant closures.

It would also be advantageous if such an improved tamper-indicating closure could be readily fabricated from thermoplastic materials and include separate pieces of contrasting color.

It would also be beneficial if such an improved closure could be provided in a form that would not require excessively complicated manufacturing operations and that would permit the use of conventional, high-speed, automatic capping machines for applying the closure to a container.

The present invention can be embodied in designs that provide one or more of the above-discussed benefits and features.

SUMMARY OF THE INVENTION

The present invention provides a tamper-indicating closure offering advantages of greater design flexibility, optional child-resistant design capability, easier manufacturing, and better compatibility with high-speed, automatic capping machines.

The closure includes a tamper-indicating element which can be designed to accommodate stacking. Further, the element can be easily designed to function as a tool for piercing a seal in the closure or container and/or for snagging and removing packing from the container. The tamper-indicating element is easily broken as the closure is first opened, and a portion of the element remaining on the closure provides readily observable evidence that the closure may have been opened.

The closure includes a base or body for attachment to the container. In the preferred embodiment, the base includes a deck defining a discharge aperture communicating with the container.

The closure also includes a lid for movement between the closed position occluding the discharge aperture and an opened position spaced from the discharge aperture. In the preferred embodiment, the lid is hingedly connected to the body.

According to one aspect of the invention, a manually releasable latch is defined cooperatively by the lid and by the base to hold the lid closed. A tamper-indicating element is mounted adjacent the latch. The element includes a removable part defining a tool for use with the closure or container. The tamper-indicating element also includes an attachment structure that has a frangible portion. The frangible portion breaks to release the removable part and to permit operation of the latch. The removable part tool can then be used (e.g., for puncturing a seal within the closure or container and/or for removing packing material from the container).

According to another form of the invention, the manually releasable latch is defined cooperatively by a locking lever on the base and by the lid to hold the lid closed. A tamper-indicating element is separate from, and is mounted solely to, the lid adjacent the latch. The element has an extending tab defining an aperture for receiving a locking lever to block operational access to the locking lever and to prevent movement of the locking that would release the latch. The tamper-indicating element is free of any attachment directly to the base. The element includes a removable part containing the tab and includes an attachment structure. The attachment structure is engaged with the lid and has a frangible portion which can be broken when sufficient force is applied to remove the removable part of the element from the lid to permit operation of the latch. The remaining part of the attachment structure remains on the lid to provide evidence that the removable part of the element has been removed.

According to yet another form of the invention, the closure has a releasable latch which interacts with a tamper-indicating element to break away a portion of the tamper-indicating element when the latch is released. The latch is defined cooperatively by the lid and by a locking lever on the base to hold the lid closed. The tamper-indicating element is not molded as part of the lid and is mounted to the lid so as to prevent operation of the latch. The element includes (1) a removable part adjacent the locking lever, and (2) an attachment structure that is engaged with the lid and that has a frangible portion which can be broken when the locking lever is moved with sufficient force against the removable part of the element to release the latch. At least a portion of the attachment structure remains on the lid to provide evidence that the tamper-indicating element has been removed.

In a preferred embodiment, the latch includes (1) a latch surface on the lid adjacent a receiving aperture defined in the lid, and (2) a locking lever unitary with, and projecting upwardly from, the base to project through the lid receiving aperture and engage the latch surface when the lid is closed.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 13 shows a pivoted, moved position of the tamper-indicating element in phantom with dashed lines;

FIG. 14 is a top, perspective view of a sixth embodiment of a tamper-indicating element;

FIG. 15 is a view similar to FIG. 3, but FIG. 15 illustrates a seventh embodiment of a tamper-indicating element installed on the closure lid;

FIG. 16 is an enlarged, fragmentary, cross-sectional view taken generally along the plane 16—16 in FIG. 15;

FIG. 22 shows the components assembled before final deformation of a portion of the closure lid; FIG. 23 shows the components of FIG. 22 with a portion of the closure lid deformed to lock the tamper-indicating element and closure lid together.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figures 1, 2, 3:
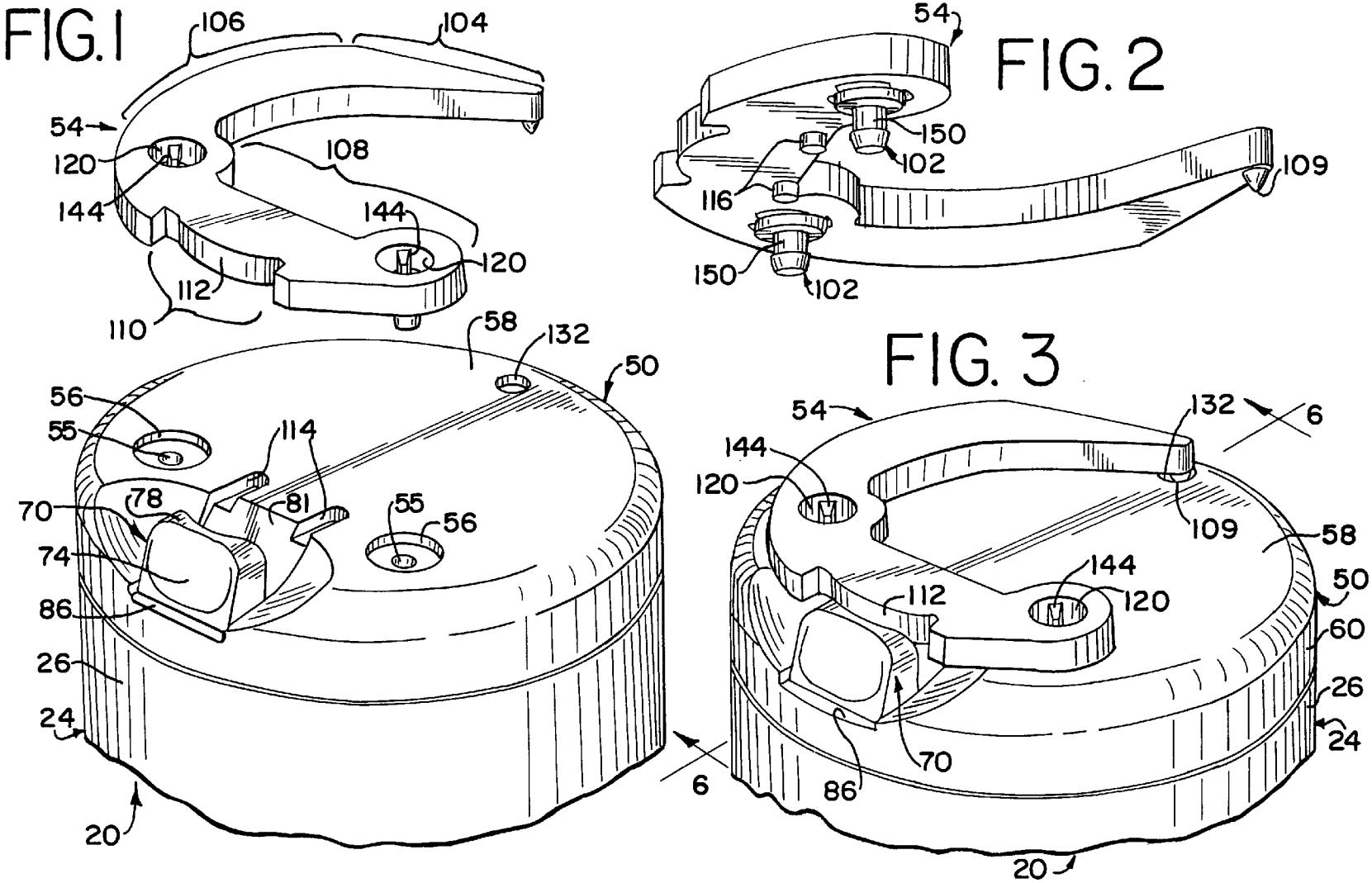
FIG. 1 is an exploded, perspective view of a first embodiment of a closure of the present invention shown with a tamper-indicating element not yet installed on the closure lid.
FIG. 2 is a perspective view of the underside of the tamper-indicating element prior to installation on the closure lid.
FIG. 3 is a perspective view of the closure shown with the tamper-indicating element in place on the closure lid.
Figure 5:
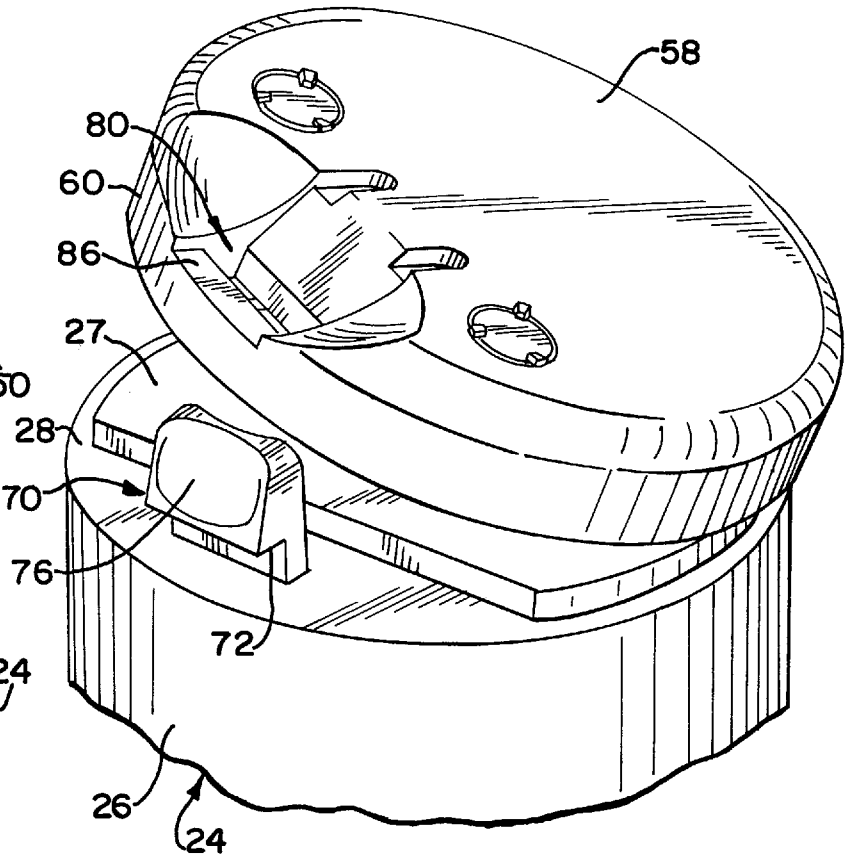
FIG. 5 is a view similar to FIG. 4, but FIG. 5 shows the lid being lifted upwardly toward an open position (and for illustration purposes, the top of the lid is tilted somewhat toward the viewer)

FIGS. 1–7 show a first embodiment of the tamper-indicating closure of the present invention, and FIG. 3 shows the closure in a fully closed condition wherein the closure is represented generally by the reference numeral 20. The closure 20 is adapted to be mounted on a container (not illustrated) which may have a conventional open mouth defined by a neck (not illustrated) or other suitable structure.

The closure 20 includes a closure base or body 24 for securement to the container. The base 24 includes a generally cylindrical, peripheral wall 26 and a generally transverse closure wall or deck 28 (FIGS. 5 and 6) which extends across the base 24. A central portion 27 of the base deck 28 is thicker so that the surrounding portion of the deck 28 defines a stepped down, peripheral shoulder.

The cylindrical wall 26 of the closure base 24 is adapted to engage the outer periphery of the top of the container neck (not illustrated) around the container mouth, as with threads (having an appropriate structure for preventing removal of the installed closure). Other suitable engaging means (e.g., snap-fit beads) may be provided to secure the closure base 24 on the container. Alternatively, in some applications the closure base 24 could be non-releasably attached to, or formed unitary with, the container.

Figure 6:
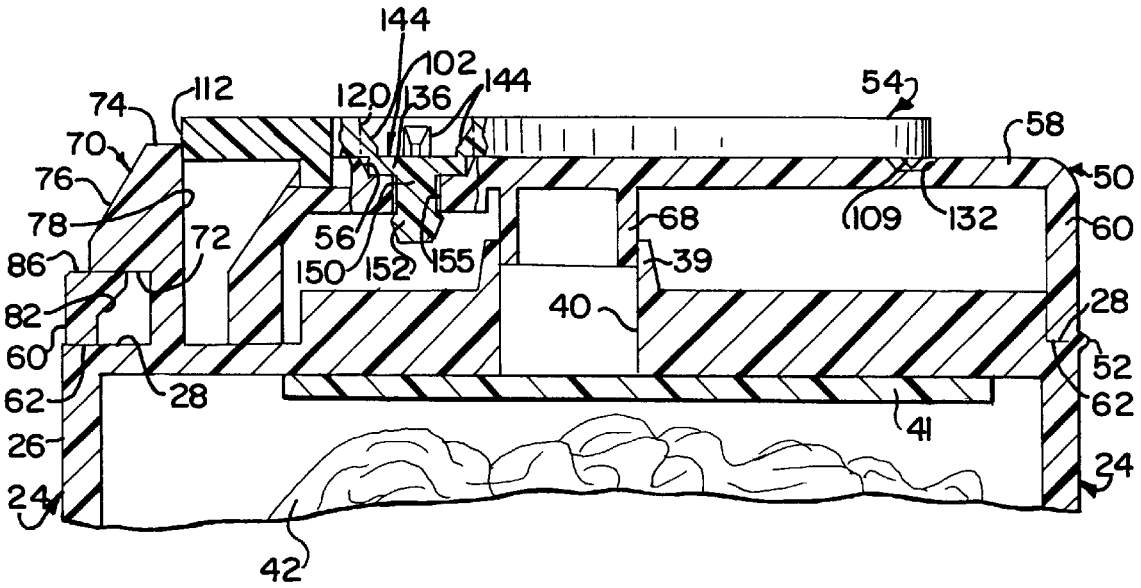
FIG. 6 is an enlarged, fragmentary, cross-sectional view taken generally along the plane 6—6 in FIG. 3.

The closure base 24 includes a discharge aperture or passage 40 through the deck 28 (FIG. 6). The closure passage 40 is surrounded by a hollow discharge tube 39. The tube 39 projects upwardly from the body deck 28. The passage 40 may be considerably larger than shown in FIG. 6. The passage 40 may occupy a major portion of the diameter of the closure deck. In some applications, it may be desirable to provide a secondary seal or freshness seal 41 (FIG. 6) across the passage 40 or across the open mouth of the container (not shown). Such a secondary seal 41 may be of any conventional or special design. The seal 41 may be, for example, a film or metal foil adhesively secured or heat-sealed to the underside of the closure body deck 28 or to the top of the container neck.

Further, some containers, especially containers of pharmaceutical pills, tablets, and the like, may include a packing or wadding material 42. In FIG. 6, the wadding or packing material 42 is shown in simplified form below the closure deck 27. Typically, the material 42 is contained within the neck of the container (not illustrated) to which the closure 20 is mounted with the closure wall 26 engaged around the container neck.

If a wadding or packing material 42 is employed in the container, then the closure passage 40 is typically much larger than illustrated in FIG. 6. In such a case, the aperture or passage 40 would typically extend across a major portion of the closure body deck raised portion 27 so as to enable access to the container contents and wadding material 42 after the closure is opened (as described in detail hereinafter).

Although not illustrated in FIG. 6, the underside of the deck 28 may be provided with a conventional or special annular sealing ring projecting downwardly adjacent the closure wall 26 for engaging an interior edge of the container neck at the container mouth to effect a tight seal.

Preferably, a lid 50 is hingedly connected by a hinge means or hinge 52 (FIG. 6) to the edge of the base 24. In the first embodiment illustrated in FIGS. 1–7, the hinge 52 is a snap-action hinge of the conventional type described in the U.S. Pat. No. 4,403,712. If a hinge is employed, it is not required that the hinge 52 be a snap-action type hinge. Any suitable hinge system may be employed for connecting the lid 50 to the base 24 consistent with the particular application requirements, aesthetics, manufacturing techniques, etc.

The lid 50 is adapted to be pivoted between (1) a closed position (FIG. 1) preventing flow of the container-stored contents through the closure, and (2) an open position moved away from the closed position to permit the dispensing of the container-stored contents from the base discharge passage 40 (FIG. 1 shows a partly open position).

Preferably the lid 50 and the closure body 24 are molded as a unitary structure from suitable thermoplastic materials, such as polypropylene or polyethylene. However, the lid 50 and body 24 could be formed as separate pieces, and preferably would in such a case be designed for subsequent assembly with a suitable connecting hinge system to permit opening and closing of the lid. The detailed design and operation of the hinge per se form no part of the present invention.

The lid 50 preferably includes a central cover panel 58 and has a peripheral skirt 60 depending from the periphery of the central cover panel 58 (FIGS. 1, 3, and 6). The lid skirt 60 has a bottom surface 62 (FIG. 6) defining a peripheral, bottom surface of the lid. The skirt bottom surface 62 is adapted to rest on the peripheral, annular shoulder of the base deck 28 when the lid 50 is closed as illustrated in FIG. 6.

The lid 50 carries a tamper-indicating element or member 54 which must be broken or removed, as explained in detail hereinafter, to provide full access to the lid for opening and closing the lid 50. The lid 50 panel 58 defines two holes 55 (FIG. 1), and each hole 55 is adapted to receive a portion of the element 54 to anchor the element 54 to the lid 50 as explained in detail hereinafter. Each hole 55 is preferably surrounded by a shallow counterbore 56.

In the embodiment illustrated in FIGS. 1–7, the lid 50 also includes a sealing spud or member 68 (FIG. 6) which projects from the central cover panel 58. The sealing member 68 is adapted to enter into the discharge opening of the hollow tube 39 projecting upwardly from the base central deck region 27 when the lid 50 is closed (FIG. 6).

It will be appreciated, however, that the base discharge tube 39 and lid sealing member 68 need not be provided in the form illustrated, or need not be provided at all. If the closure 20 is used with liquids, then other means for sealing the closure lid 50 and base 24, as around the lid skirt bottom surface 62, may be employed. If the closure 20 is designed for a container for pills or other individual items, then a major portion of the base deck central portion 27 may be eliminated in order to provide a relatively large access opening to the container. In such a case, the discharge tube 39 per se and lid sealing member 68 could be eliminated.

A novel latching mechanism is provided for maintaining the lid 50 in the closed position and inhibiting a child from opening the closure—even after the element 54 is removed (as explained in detail hereinafter). Specifically, at the front of the closure 20, diametrically opposite from the hinge 52, the base 24 has a resilient locking lever 70 (FIGS. 1, 3, and 6) which projects upwardly from the base deck 28 at a location inwardly of the periphery of the base. The locking lever 70 has an outwardly extending, and downwardly facing, shoulder 72 (FIG. 6). The lever 70 is relative stiff, and a small child would find it difficult, if not impossible, to use a finger to bend or deflect the locking lever 70 rearwardly toward the hinge 52.

As seen in FIG. 6, the locking member 70 has an upper distal end 74 and a sloping camming surface 76 against which the lid 50 acts as explained hereinafter. The lever 70 also has a rear surface 78 (FIG. 6).

The lid central cover panel 58 defines an aperture 80 (FIG. 5) inwardly of the periphery of the lid for receiving the lever 70 when the lid is closed (FIG. 6). The bottom of the aperture 80 opens at the bottom surface of the lid.

The rear upper portion of the aperture 80 is defined in part by a slanting rear surface 81. The front of the aperture 80 is defined in part by an inwardly slanting, planar, front wall 82 (FIG. 6). The wall 82 acts as a cam surface for engaging the lever camming surface 76 as the lid 50 is pivoted downwardly to the fully closed position. As the front wall 82 and lever surface 76 engage, the lever 70 is deflected rearwardly. This accommodates movement of the lid 50 to the fully closed position wherein the lid skirt seating surface 62 engages the base deck 28.

The upper, front edge of the lid aperture 80 is defined by a horizontally disposed latch surface 86 (FIGS. 1 and 6) at an elevation slightly below the elevation of the downwardly facing shoulder 72 on the lever 70. Thus, when the lid 50 is fully seated in the closed position (FIG. 6), the lever 70 returns to its normal, undeflected position owing to the inherent resiliency of the lever material. When the locking lever 70 has returned to the normal, unstressed position illustrated in FIG. 6, the locking lever shoulder 72 overlies the lid latch surface 86 and prevents the lid 50 from being pivoted upwardly unless the locking lever 70 is first pivoted rearwardly.

Figure 4:
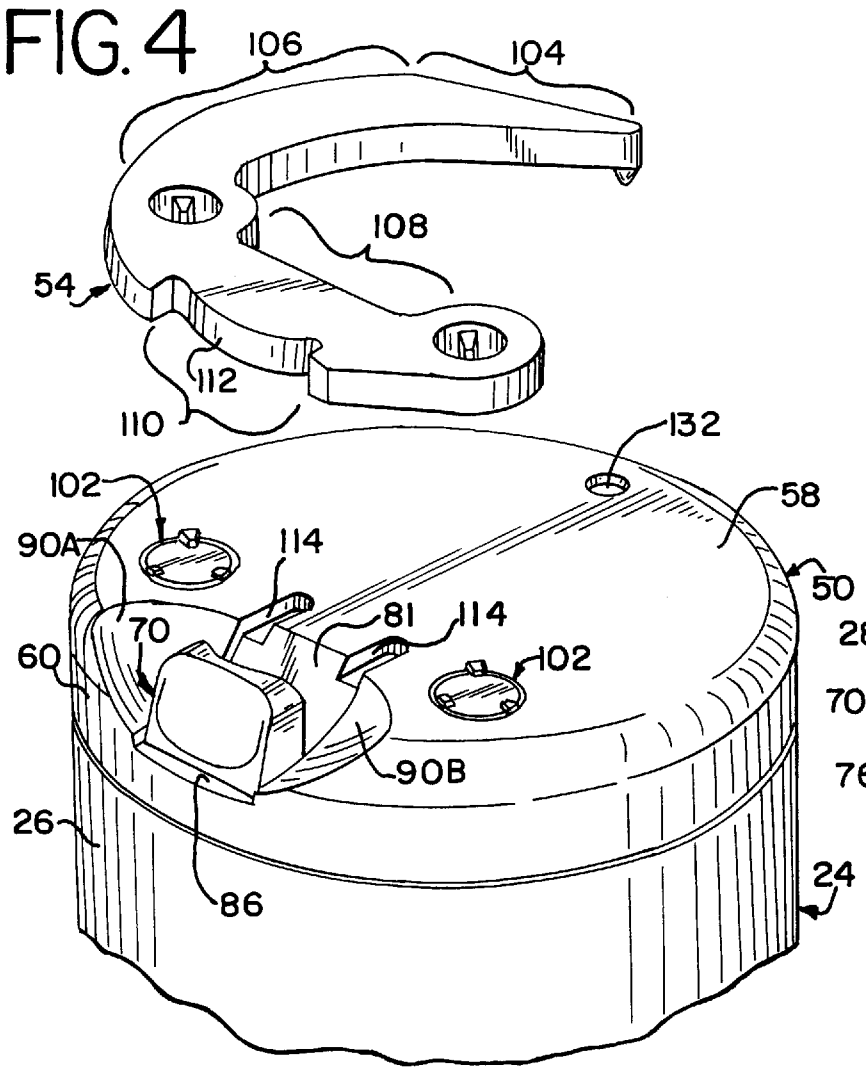
FIG. 4 is view similar to FIG. 3, but FIG. 4 shows a removable part of the tamper-indicating element after it has been removed from the closure lid by breaking the frangible portion of the tamper-indicating element.

When the lid 50 is fully closed as illustrated in FIGS. 3, 4, and 6, the clearance around the top end of the lever 70 is relatively small. This reduces the exposure of the lever 70 to engagement with a child's teeth and inhibits efforts of a child to bend the lever 70 rearwardly. Further, the small clearance around the lever 70 inhibits the insertion of a child's teeth under the lever shoulder 72.

However, in order to facilitate opening of the closure by an adult user after removal of the tamper-indicating element 54, the lid 50 defines a finger access recess around, and extending from the aperture, and the recess is defined in part by two, spaced-apart, concave, curved surfaces 90A and 90B (FIG. 4). The surfaces 90A and 90B accommodate the width of a typical adult finger so that an adult can position a finger adjacent the upper front portion of the locking lever 70 and push the locking lever 70 rearwardly. However, the overall extent of the depth and width of the adjacent surfaces 90A and 90B are relatively small so as to reduce the exposure of the lever 70 to engagement with a child's teeth and so as to inhibit efforts of a child to bend the lever 70 rearwardly.

Further, if desired, the top of the locking lever distal end 74 could be recessed slightly below the top of the adjacent central cover panel 58 of the lid.

Further, as can be seen in FIG. 6, the peripheral region of the lid 50, including the skirt 60, extends outwardly beyond the front of the locking lever 70 to prevent a child's teeth from engaging the front of the lever 70.

To further assist an adult user in opening the closure (after the tamper-indicating element 54 has been removed), the skirt 60 of the lid 50 could be provided with a pair of finger-engaging surfaces on each side of the latch area. Such optional finger-engaging surfaces could be defined in the skirt lid 60 by a shallow indentation (such as indentations 92 shown in the closure illustrated in FIGS. 1 and 3 of U.S. Pat. No. 5,462,183 and described in the patent).

Preferably, the exterior surface of the skirt 60 immediately below the latch surface 86 (FIG. 3) is substantially vertical and smooth, and is somewhat forward of the locking lever shoulder 72 (FIG. 6), so as to eliminate or reduce the presence of surfaces or edges that could be engaged by a child's teeth to separate or distort the structures in the region of the locking lever 70.

In addition, the portion of the base 24 that extends from the hinge 52 is configured to project peripherally outwardly at least as far as the lid bottom surface 62. Preferably, the front portion of the base 24 extends peripherally outwardly further than the lid skirt bottom surface 62 as illustrated in FIGS. 1 and 6. Because the front portion of the base 24 normally projects beyond the closed lid 50, the closure has a larger range of manufacturing (molding) tolerances. That is, the molding of a slightly larger lid would still not result in the front portion of the lid projecting peripherally beyond the base 24 so as to create an overhanging ledge that could be engaged by a child's teeth. Thus, the closure has the capability for more easily accommodating manufacturing processes.

The above-described first embodiment of the closure has child resistance capabilities. Because the closure has an inset latch structure and a lid free of overhanging peripheral surfaces with a depth sufficient to be engaged by a child's teeth, the lid is highly resistant to being pried open by a child's teeth. The smooth contours of the lid in the finger lift areas and in the locking lever area eliminate sharp edges and ledges so as to prevent a child's teeth from effectively engaging the closure in a manner that could deform and distort the closure to permit opening.

Further, the lid recess area around the locking lever 70 is configured so that if a child bites down on the top, front portion of the lid 50, then the child's teeth will only force the closure lid more tightly against the closure base. The front surface of the locking lever 70, with its smooth, curved contour, resists being effectively engaged by a child's teeth. On the other hand, engagement of the rear surface of the locking lever by some means, as with some external instrument inserted between the lever and lid, will serve only to push the locking lever further forwardly into a greater engagement with the lid.

The tamper-indicating element 54 is mounted to the top of the lid 50 as illustrated in FIG. 3. It is broken by operation of the latch lever 70. The tamper-indicating element 54 includes a removable part which is broken away from the top of the lid 50 as the lever 70 is pushed rearwardly. When the tamper-indicating element 54 is broken away, as illustrated in FIG. 4, two front anchor portions 102 remain on the lid deck 58. These provide an indication that part of the tamper-indicating element 54 has been removed. This tells the user that the closure 20 is, and has been, in condition for opening, and therefore, that the closure may have been opened. Thus, the anchor portions 102 retained on the closure lid 50 function as tamper-evident indicia and are evidence that the integrity of the closure can no longer be guaranteed.

The first embodiment of the tamper-indicating element 54 has a hook-like configuration. The element 54 has a distal end portion 104 (FIG. 4), an intermediate curving portion 106, and a shank portion 108. The distal end portion 104 includes a barb or sharp point 109 which, after breaking the exposed portion of the tamper-indicating element away, can be used for piercing the seal 41 (FIG. 6) and/or for snagging and removing packing material 42 from the container. If necessary, depending upon the height of the anchor portions 102 and the height of the barb 109, the lid 50 may define a recess 132 for receiving the barb 109 so as to maintain the element 54 in a substantially horizontal or flat orientation on the lid 50.

The shank portion 108 of the element 54 has a notch 110 defining a curved abutment surface 112 for being engaged by the rear surface 78 of the locking lever 70.

A system is provided to guide the tamper-indicating element 54 as it is broken on the lid 50. To this end, the deck 58 of the lid 50 defines a pair of parallel slots or grooves 114 (FIG. 1), and the tamper-indicating element shank 108 has a pair of downwardly projecting pegs 116 (FIG. 2). Each of the pegs 116 is received in one of the slots 114. The slots 114 and pegs 116 may be omitted, if desired.

The distal end 104 of the tamper-indicating element 54 is disposed generally flat on the lid deck 58. The lid deck 58 defines a smooth recess 132 (FIGS. 1 and 6) for receiving the downwardly projecting barb 109.

As can be seen in FIG. 1, the shank portion 108 of the element 54 has two holes 120. As shown in FIGS. 2 and 6, each front anchor portion 102 is connected to the shank portion 108 at the periphery of a hole 120. In particular, each anchor portion 102 includes a particular, generally disk-shaped, load-bearing plate 136 (FIGS. 2 and 6) which is connected to the bottom of the element 54. In the preferred embodiment, the element 54 is molded from thermoplastic material (e.g., polypropylene) as a unitary structure. Each disk-shaped plate 136 is molded as a unitary extension of the element 54. Specifically, each disk-shaped plate 136 is connected to the element 54 at each of the three corner regions with a frangible rib 144 at the edge of the hole 120. The rib connection between the plate 136 and the lid deck 58 is relatively thin and defines a frangible connection.

Projecting downwardly from the underside of each of the disk-shaped plates 136 is an anchor post 150. The anchor post 150 has an enlarged diameter head 152 with a frustoconical, tapered distal end. Each post 150 is adapted to be received in one of the two lid holes 55. Each post 150 is concentric with the tamper-indicating element hole 120 (FIGS. 3 and 6). When the tamper-indicating element 54 is installed on the closure lid 50, each post 150 is also concentric with the receiving hole 55 in the lid deck 58 (FIGS. 1 and 6).

Preferably, the diameter of the shaft of the post 150 (above the enlarged head 152) is slightly larger than the diameter of the lid hole 55. The enlarged head 152 is also necessarily larger than the diameter of the hole 55. The tapered, frustoconical distal end of the post 150 accommodates insertion of the post 150 into the hole 55 in the lid 50. The lower distal end of the tapered end of the post has a diameter less than the diameter of the lid receiving hole 55 to accommodate insertion. During insertion, the hole 55 is temporarily deformed (enlarged) to accommodate the insertion of the larger head 152. The hole 55 remains slightly enlarged to accommodate the slightly larger diameter shank of the post 150.

Figure 7:
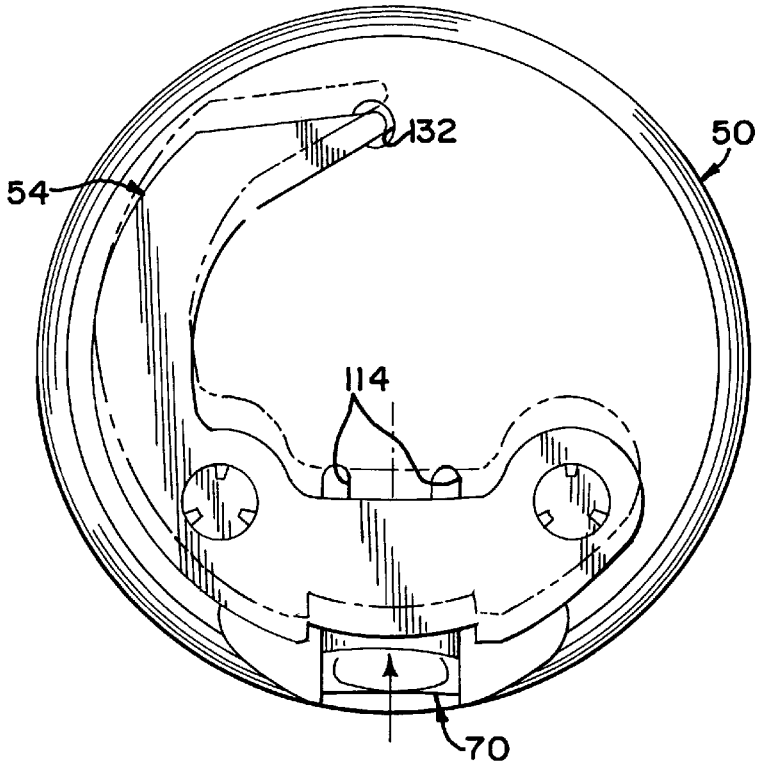
FIG. 7 is a top, plan view of the closure shown in FIG. 3 with a moved position of the tamper-indicating element shown in phantom with dashed lines.

The frangible ribs 144 connecting the disk-shaped plate 136 to the lid 50 are strong enough to accommodate the compressive forces generated during insertion of the posts 150 when the closure is assembled. However, each frangible connection rib 144 will break when sufficient tensile and/or bending forces are applied to the element 54 if it is forced to move rearwardly (toward the hinge 52 (FIG. 6)) or upwardly. When the locking lever 70 is initially pushed rearwardly with sufficient force to disengage from the lid latch surface 86, the lever 70 engages the abutment surface 112 of the element 54 and moves the element 54 rearwardly. The slight rearward movement of the tamper-indicating element 54 is illustrated in FIG. 7. In FIG. 7, the initial, installed location of the element 54 is illustrated in solid lines. As the element 54 is forced rearwardly by the locking lever 70, the frangible ribs 144 break. The moved location of the tamper-indicating element 54 when the ribs 144 completely break is shown in FIG. 7 as a phantom position illustrated with dashed lines. The lid grooves 114 (FIGS. 1 and 7) guide the tamper-indicating element pegs 116 (FIG. 2) during the small rearward movement of the tamper-indicating element. When the ribs 144 break, the anchor portions 102 (FIG. 4) remain in the lid 50. The anchor portions 102 are prevented from being pulled out of the lid 50 owing to the enlarged heads 152 on the posts 150.

When the frangible ribs 144 are fractured, the remaining anchor portions 102 retained on the lid 50 are readily visible after the rest of the element 54 falls, or is lifted, away.

The portion of the tamper-indicating element 54 above the plates 136 constitutes the removable part of the element. The removable part can be discarded or can be used as a tool to pierce the seal 41 (if present) and/or snag and remove the container wadding 42 (if present).

The anchor portions 102, along with the associated frangible ribs 144, may be defined as the attachment structure for attaching the tamper-indicating element to the closure lid 50. Upon rupture of the frangible ribs 144, the removable part of the element is lifted away or falls away, and the remaining part of the attachment structure on the lid includes only the anchor portions 102 and perhaps small, broken portions of the ribs 144 as shown in FIG. 4.

Figure 8:
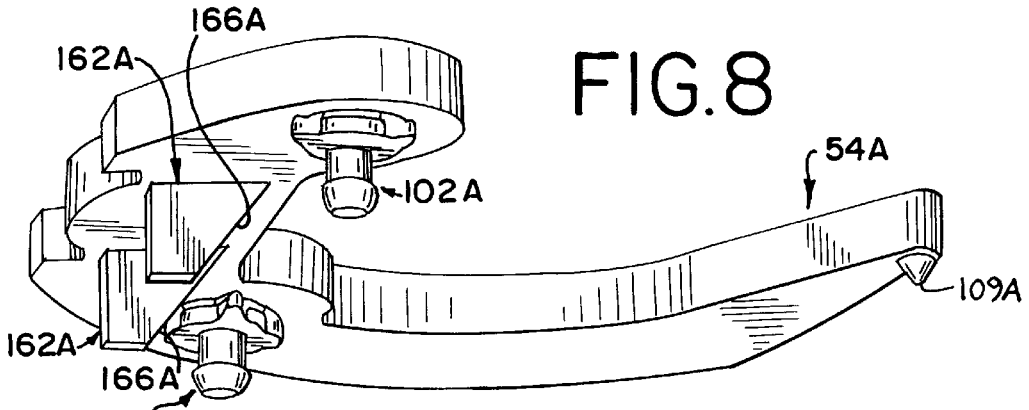
FIG. 8 is a perspective view of the underside of a second embodiment of the tamper-indicating element.

A second embodiment of the tamper-indicating element of the present invention is illustrated in FIG. 8 and is designated generally therein by reference number 54A. The tamper-indicating element 54A is adapted for mounting to the lid of a closure wherein the closure lid and base have substantially the same configuration as the closure lid 50 and base 24, respectively, described above with reference to FIGS. 1–7.

The second embodiment of the tamper-indicating element 54A has the same hook-like configuration as does the previously described first embodiment of the tamper-indicating element 54. The element 54A has a barb 109A identical with the barb 109 of the first embodiment element 54. The element 54A also has a pair of anchor portions 102A which are identical with the anchor portions 102 of the first embodiment tamper-indicating element 54.

The second embodiment of the tamper-indicating element 54A does not, however, have the downwardly projecting pegs 116 which are illustrated in FIG. 2 for the first embodiment of the tamper-indicating element 54. Instead, the second embodiment of the tamper-indicating element 54A includes a pair of spaced-apart stiffening ribs 162A. Each rib 162A has an angled or slanting camming surface 166A. The camming surfaces 166A are adapted to engage the downwardly slanting surface 81 of the closure lid behind the locking lever 70 (FIG. 1). The surfaces 166A on the ribs 162A cause the front of the tamper-indicating element 54A to move upwardly as the element 54A is pushed rearwardly when the locking lever 70 is pushed rearwardly against the element 54A. This camming action serves to impose a greater tension load on the anchor portion frangible ribs (identical with ribs 144 described above in detail with respect to the first embodiment illustrated in FIGS. 1–7), and this assists in breaking the anchor portions 102A.

Figure 9:
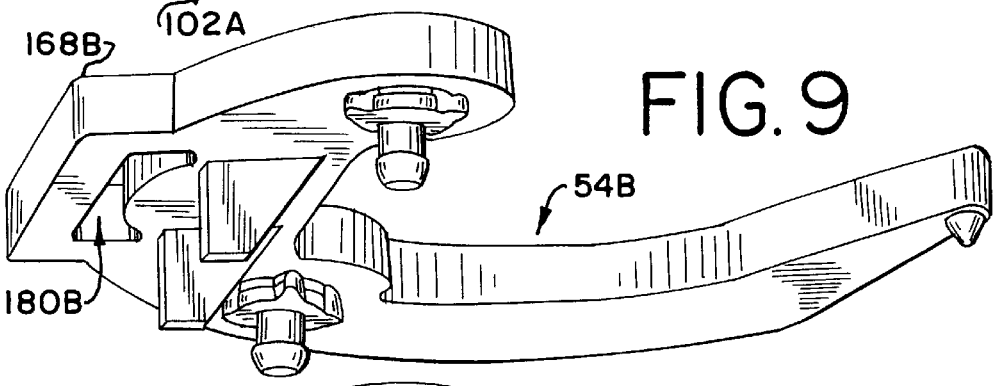
FIG. 9 is a perspective view of the underside of a third embodiment of the tamper-indicating element.
Figure 11:
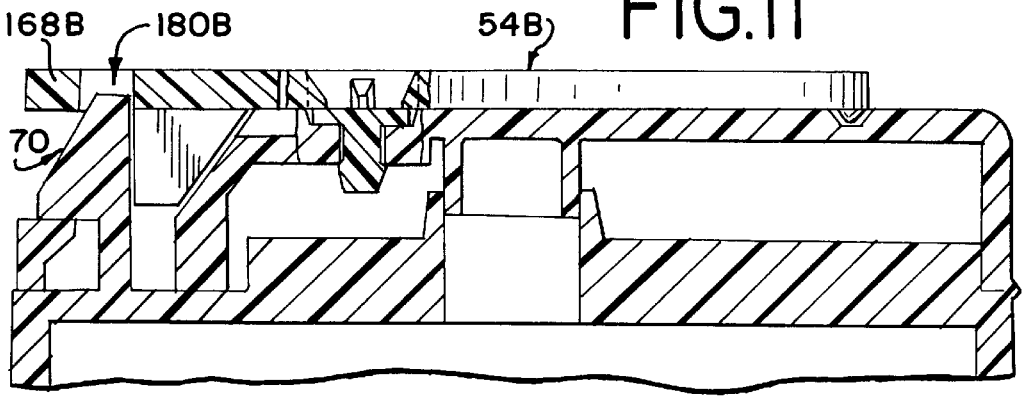
FIG. 11 is a view similar to FIG. 6, but FIG. 11 shows the third embodiment of the tamper-indicating element illustrated in FIG. 9 installed on the closure lid.

FIGS. 9 and 11 illustrate a third embodiment of the tamper-indicating element designated generally by the reference number 54B. The element 54B includes the same features as described above for the second embodiment of the tamper-indicating element 54A illustrated in FIG. 8. In addition, the third embodiment of the tamper-indicating element 54B includes an additional feature in the form of a forwardly projecting tab 168B which defines a slot 180B for receiving the upper end of the locking lever 70 of the closure base when the element 54B is mounted on the closed closure lid (FIG. 11). Depending upon the height of the locking lever 70 and the thickness of the tab 160B, the element 54B may prevent a person's finger from engaging and pushing against the lever 70. In such a case, the element 54B must be grasped and lifted upwardly to first break it away from the closure lid so as to expose the locking lever 70.

Figure 10:
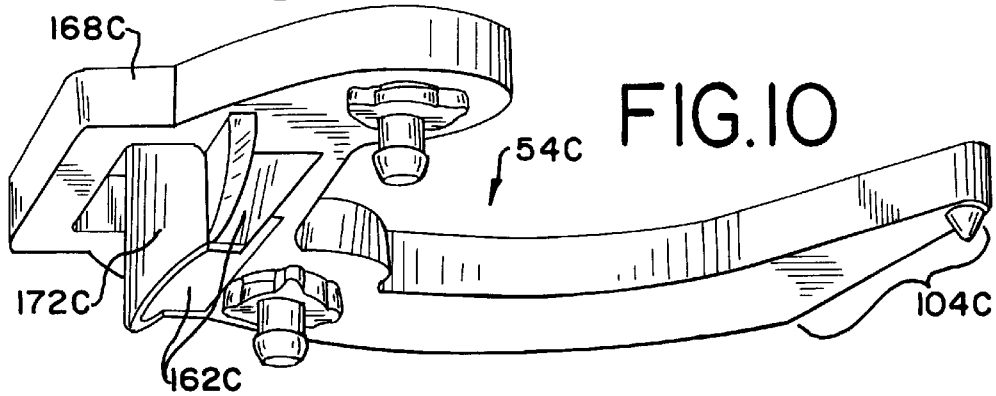
FIG. 10 is a perspective view of the underside of a fourth embodiment of the tamper-indicating element.

FIG. 10 illustrates a fourth embodiment of a tamper-indicating element designated generally by the reference numeral 54C. The element 54C is similar to the element 54B described above with reference to FIG. 9. However, the element 54C also includes a downwardly projecting, curved connecting wall 172C which connects two parallel, spaced-apart ribs 162C. The ribs 162C are located so as to prevent establishment of fulcrum points that might otherwise cause rocking of the element 54C. The ribs 162C can function as camming members when the element tab 168C is gripped and lifted upwardly or when the distal end portion 104C is gripped and lifted upwardly to break the element away from the closure lid. The ribs 162C would act as a fulcrum against the closure lid recess surface 81 (FIGS. 1 and 6).

Figure 12:
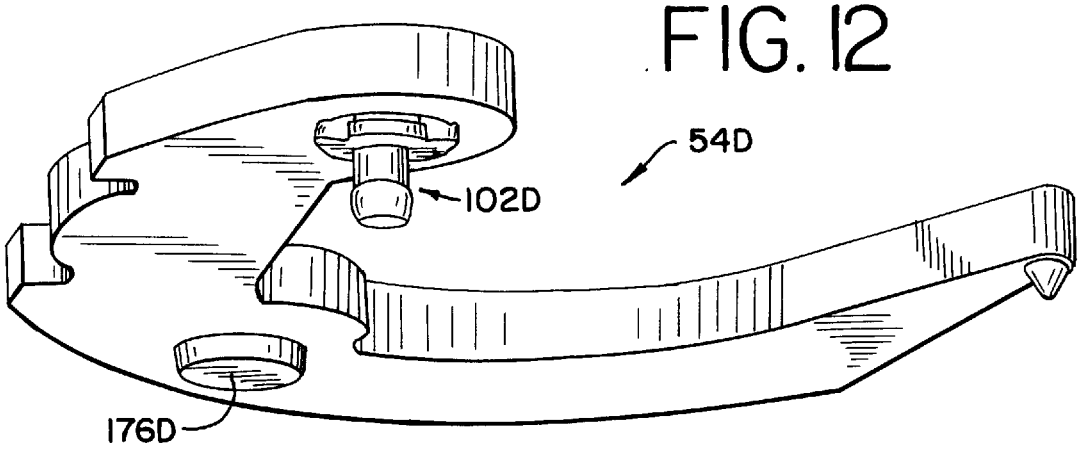
FIG. 12 is a perspective view of the underside of a fifth embodiment of a tamper-indicating element.

FIG. 12 illustrates a fifth embodiment of a tamper-indicating element 54D. The element 54D is similar to the element 54 described above with reference to FIGS. 1–7. However, whereas the element 54 has two anchor portions 102, the element 54D has only one anchor portion 102D. The second anchor portion is replaced with a cylindrical, pivot post 176D which is received within one of the lid counterbores 56 (FIG. 1).

Figure 13:
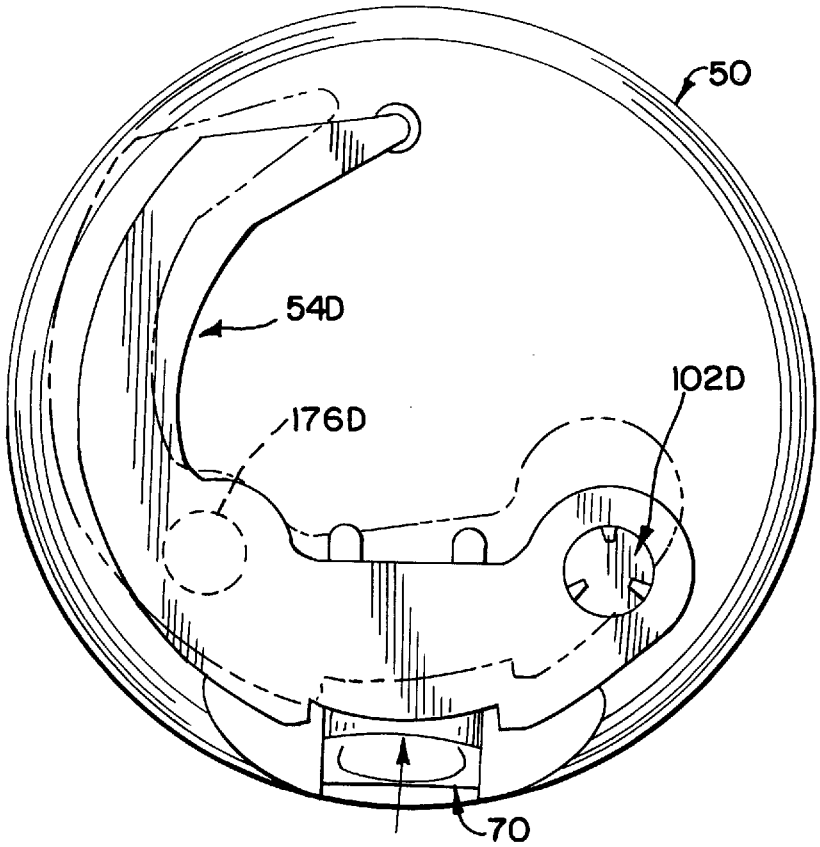
FIG. 13 is a top, plan view of a closure with the fifth embodiment of the tamper-indicating element shown in FIG. 12 installed on the closure lid.

As illustrated in FIG. 13, when the fifth embodiment of the tamper-indicating element 54D is engaged by the rearwardly pushed locking lever 70, the element 54D pivots on the post 176D (counterclockwise as viewed in FIG. 13) as the anchor portion 102D breaks. The tamper-indicating element 54D is then free to fall off of, or be lifted away from, the closure lid 50.

FIG. 14 illustrates a sixth embodiment of the tamper-indicating element designated generally by the reference numeral 54E. The element 54E has two front anchor portions 102E identical with the anchor portions 102A of the second embodiment of the tamper-indicating element 54A described above with reference to FIG. 8. In addition, the sixth embodiment of the tamper-indicating element 54E has one stiffening rib 162E which defines a forwardly facing abutment edge or bearing edge 163E. The bearing edge 163E is disposed behind, and adjacent, the locking lever (such as lever 70 in FIG. 1). The edge 163E is adapted to be engaged, and pushed by, the locking lever 70 when the locking lever 70 is pushed rearwardly to open the latch.

The sixth embodiment of the tamper-indicating element 54E also includes a distal end portion 104E which is connected to the closure lid with a third anchor portion 102E'. The closure lid would include a third bore and counterbore for cooperating with the third anchor portion 102E'. Such a third bore and counterbore would be identical with one of the sets of bores 55 and counterbores 56 described above with reference to the closure lid illustrated in FIG. 1.

When the closure locking lever is pushed rearwardly against the tamper-indicating element rib edge 163E to release the latch, the force breaks all three of the anchor portions so that the removable part of the element 54E falls away or can be grasped for using as a tool. The distal end portion 104E may be used as a piercing member for piercing a seal within the closure or across the container opening and/or for snagging and removing packing material from the container. A barb or point (not visible in FIG. 14) may project downwardly from the underside of the distal end portion 104E of the element 54E to further assist in such manipulations.

FIG. 15 illustrates a seventh embodiment of the tamper-indicating element designated generally by the reference numeral 54F. The element 54F is mounted on the lid 50 of the closure. The element 54F has a configuration similar to the configuration of the first embodiment of the tamper-indicating element 54 described above with reference to FIGS. 1–7. However, the seventh embodiment of the tamper-indicating element 54F includes an outwardly extending tab 168F which defines a slot 180F for receiving the upper end of the locking lever 70. The tab 168F includes a generally concave portion shaped to substantially conform to the shape of the surface of the underlying closure lid around the lever 70. The conforming configuration of the tab 168F is illustrated in the cross-sectional view in FIG. 16.

The tamper-indicating element 54F may be first removed by pulling upwardly on the front edge of the tab 168F. Alternatively, the upper portion of the lever 70 can be pushed rearwardly to apply a force to the tamper-indicating element 54F sufficient to break the frangible anchor portions which connect the element 54F to the lid 50.

Figure 17:
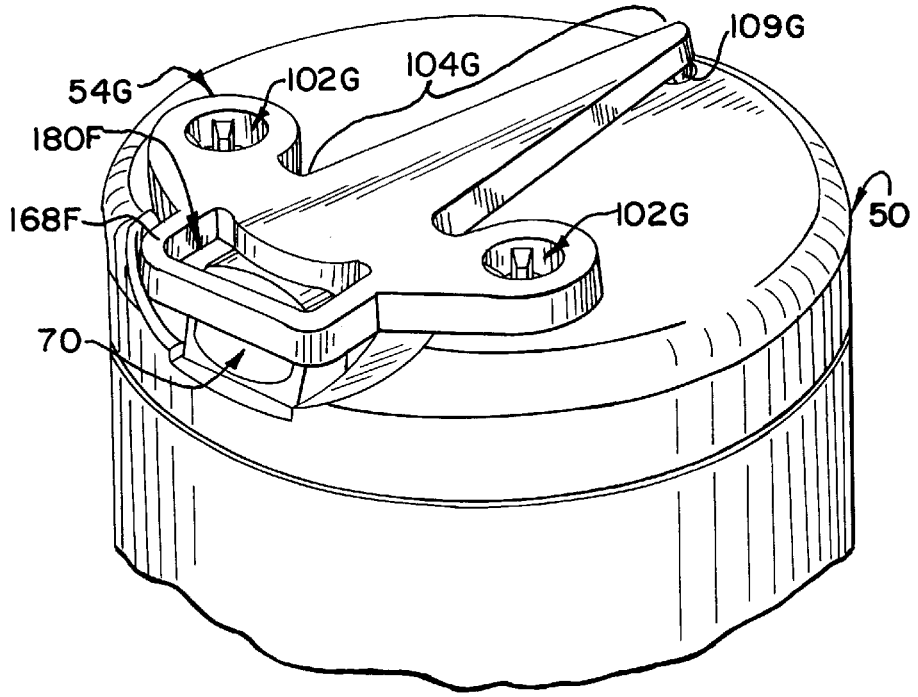
FIG. 17 is a view similar to FIG. 3, but FIG. 17 illustrates an eighth embodiment of a tamper-indicating element installed on the closure lid.

An eighth embodiment of a tamper-indicating element 54G is illustrated in FIG. 17. The element 54G includes two anchor portions 102G which are connected to the lid 50 in the same manner as are the anchor portions 102 of the first embodiment of the tamper-indicating element 54 described above with reference to FIGS. 1–7. The portion of the element 54G adjacent the locking lever 70 has an extending tab 168F defining a slot or aperture 180F for receiving the upper end of the locking lever 70.

The tamper-indicating element 54G includes a distal end portion 104G extending directly rearwardly from the tab 168F toward the hinge area of the closure lid 50. A barb or point 109G is provided on the underside of the distal end portion 104G. The distal end portion 104G may be employed to puncture a seal and/or remove packing material.

The tamper-indicating element 54G may also include one or more stiffening ribs such as the ribs 162A described above with reference to the second embodiment of the tamper-indicating element 54A illustrated in FIG. 8. Such stiffening ribs may include a rear camming surface for engaging and sliding up along the closure lid surface behind the locking lever 70.

The tamper-indicating element 54G may be initially removed by pushing or pulling on it so as to break the frangible anchor portion 102G. Then the locking lever 70 can be pushed rearwardly to release the latch so that the lid 50 can be raised.

Figure 18:
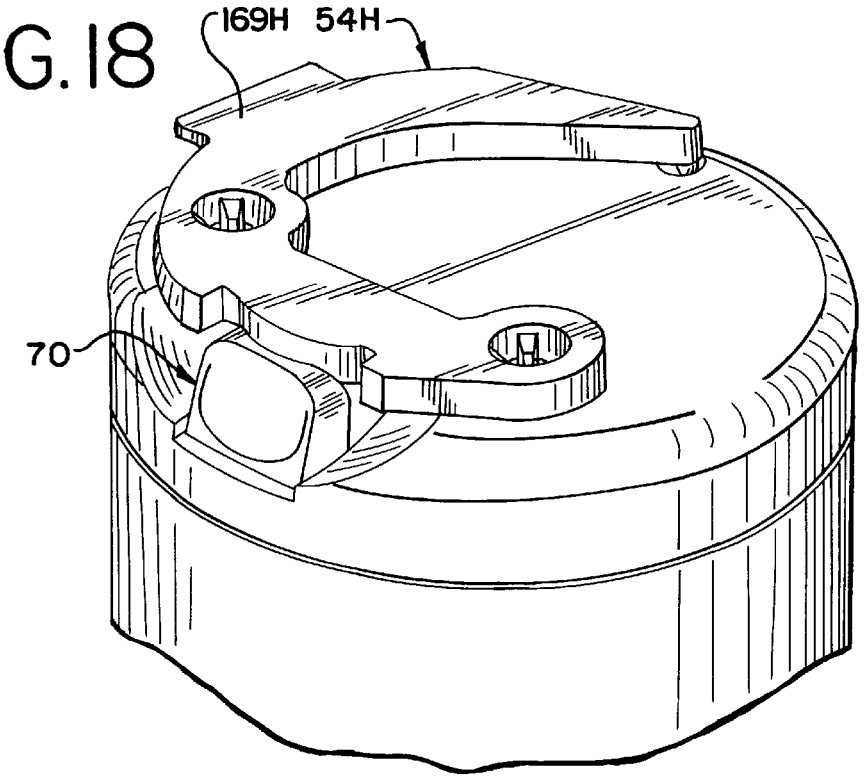
FIG. 18 is a view similar to FIG. 3, but FIG. 18 illustrates a ninth embodiment of a tamper-indicating element installed on the closure lid.

FIG. 18 illustrates a ninth embodiment of a tamper-indicating element designated generally by the reference number 54H. The tamper-indicating element 54H includes all of the basic features that are included in the first embodiment of the tamper-indicating element 54 described above with reference to FIGS. 1–7. However, the ninth tamper-indicating element 54H includes an additional feature in the form of a laterally extending tab 169H. The tab 169H may be grasped to persist in holding and/or lifting the element 54H. The element 54H may be broken away from the closure by either pushing rearwardly against the element with the lever 70 or by lifting up on the tab 169H.

Figure 19:
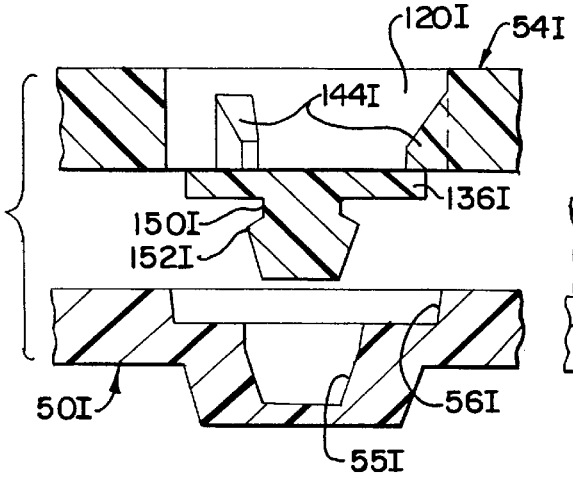
FIG. 19 is an exploded, fragmentary, cross-sectional view of a modified attachment structure for attaching a tamper-indicating element to a closure lid.

FIGS. 19–23 illustrate alternative anchor means for attaching the tamper-indicating element to the closure lid. FIG. 19 illustrates a section of an anchor portion of a tamper-indicating element 54I defining a hole 120I. The element 54I may have an additional (second) such anchor portion (not shown) or may have three or more such anchor portions. The remaining, non-anchor portions of the tamper-indicating element 54I that are not shown in FIG. 19 could have the same configurations as, and could serve the same purposes as, the non-anchor portions of any of the previously described elements 54, 54A, 54B, 54C, 54D, 54E, 54F, 54G, and 54H. Ribs 144I extend radially inwardly from the side of the hole 120I and are frangibly connected to an anchor plate 136I. An anchor post 150I projects downwardly from the plate 136I and terminates in an enlarged head 152I having a frustoconical lever surface.

Figure 20:
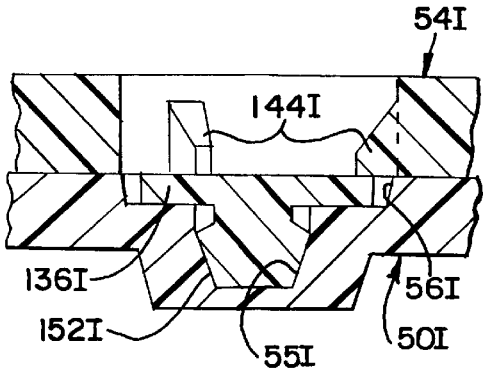
FIG. 20 is a view similar to FIG. 19, but FIG. 20 illustrates the components of FIG. 19 in a fully assembled condition.

The tamper-indicating element 54I is adapted to be attached to a closure lid 50I which defines a receiving bore 55I for receiving the head 152I and which defines a larger diameter counterbore 56I for receiving the plate 136I. The tamper-indicating element 54I can be secured to the closure lid 50I as illustrated in FIG. 20. The tamper-indicating element anchor post 152I can be welded or adhesively secured within the bore 55I of the closure lid 50I. Alternatively, or in addition, the anchor plate 136I of the element 54I can be welded or adhesively secured within the counterbore 56I of the closure lid 50I.

Figure 21:
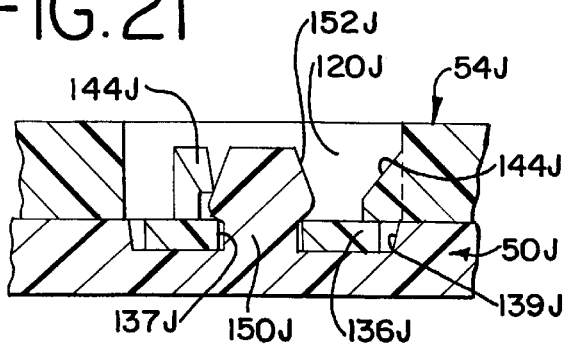
FIG. 21 illustrates another modification of means for attaching a tamper-indicating element to a closure lid.

FIG. 21 illustrates an anchor system wherein a tamper-indicating element 54J defines a circular hole 120J from which frangible ribs 144J project radially inwardly. An anchor plate 136J is connected to the bottoms of the ribs 144J. The plate 136J defines a bore 137J. The closure lid 50J has a recess 139J for receiving the anchor plate 136J. The closure 50J also includes an anchor post 150J with an enlarged head 152J. The hole 137J in the anchor plate 136J can be temporarily expanded to accommodate passage of the enlarged head 152J into the snap-fit engagement illustrated in FIG. 21.

In the embodiments illustrated in FIGS. 20 and 21, the ribs 144I and 144J connecting the anchor plates 136I and 136J, respectively, are frangible and break adjacent the plates when a sufficient load is imposed. This permits the removable portion of the tamper-indicating element to fall away or otherwise be removed.

Figure 22:
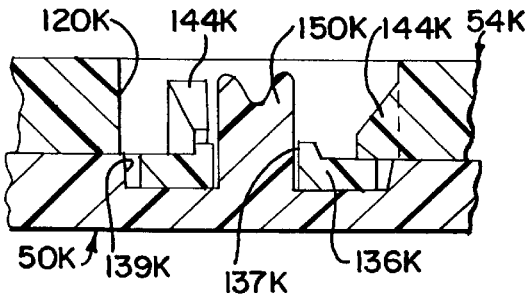
FIG. 22 illustrates another modification of means for attaching a tamper-indicating element to a closure lid.
Figure 23:
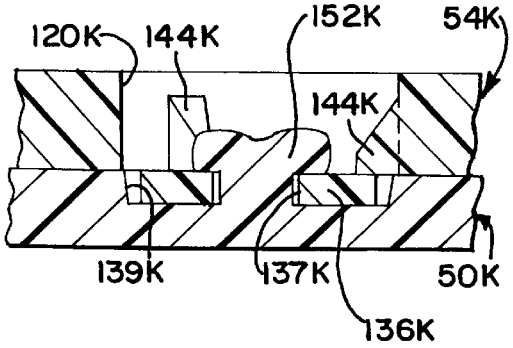
FIG. 23 is a view similar to FIG. 22.

FIG. 22 illustrates a tamper-indicating element 54K defining a circular hole 120K. Ribs 144K project radially inwardly from the cylindrical wall of the hole 120K and are frangibly connected to an anchor plate 136K. The closure lid 50K defines a bore or recess 139K for receiving the plate 136K. The closure lid 50K also includes an upwardly projecting pre-form post 150K which is received in a bore 137K defined in the anchor plate 136K. After the two components are assembled as illustrated in FIG. 22, the upper, distal end of the pre-form post 150K can be mechanically deformed (by suitable conventional or special means, including with or without ultrasonic energy) as illustrated in FIG. 23 to create a deformed head 152K which securely engages the anchor plate 136K.

When a sufficient load is imposed on the tamper-indicating element 54K, the frangible ribs 144K break to separate from the anchor plate 136K. This permits removal of the removable portion of the tamper-indicating element 54K.

The illustrated embodiments of the closure of the present invention accommodate product flexibility. For example, for many of the illustrated embodiments, only one basic design of the lid and body unit need be manufactured with anchor post receiving holes (e.g., holes 55 in FIG. 5). In those applications where a tamper-indicating element is not needed or desired, the closure lid and body may be used without the element installed. If the receiving holes would not be aesthetically acceptable in such a non-tamper-evident closure, then a relatively simple modification of the mold parts would permit the lid to be molded without the holes. An adjustable mold assembly, which could accommodate molding the lid with or without the element-receiving holes, would thus provide manufacturing flexibility at a reduced cost.

It will be appreciated that other modifications may be made to the closure body, lid, and tamper-indicating element. For example, the locking lever (e.g., lever 70 in FIG. 1) may be replaced with some other suitable latching structure, the operation of which would directly break, or require the prior breaking of, the tamper-indicating element (e.g., element 54 in FIG. 3). Further, the tamper-indicating element may have a shape other than the shapes disclosed in the figures. Additionally, the tab 169H employed on the element 54H shown in FIG. 18 could be provided on the other tamper-indicating elements shown in the other figures. Also, the element may be anchored to the lid with one, two, three, four, or more anchor portions. Further, the structure of the anchor portions may be changed from that shown in the figures. Additionally, the barb or point, such as the barb 109 shown in the first tamper-indicating element 54 illustrated in FIG. 2, may have other shapes. For example, the barb may have a saber tooth shape or a frustoconical shape. The barb may extend beyond the sidewall of the lid and might be used as a grasping tab for assisting in removing the tamper-indicating element.

It will be readily apparent from the foregoing detailed description of the invention and from the illustrations thereof that numerous variations and modifications may be effected without departing from the true spirit and scope of the novel concepts or principles of this invention.

What is claimed is:

1. A tamper-evident closure for an opening to a container interior, said closure comprising:

(1) a base for attachment to said container, said base including a discharge aperture, (2) a lid movable between a closed position occluding said discharge aperture and an open position spaced from said discharge aperture, and (3) a manually releasable latch defined cooperatively by said lid and by a locking lever on said base to hold said lid closed; and a tamper-indicating element that is mounted solely to said lid adjacent said latch and that is free of any attachment directly to said base, said tamper-indicating element including a removable part adjacent said locking lever and including an attachment structure that is engaged with said lid and that has a frangible portion which breaks when said locking lever is moved with sufficient force against said removable part of said tamper-indicating element to release said latch whereby a remaining part of said attachment structure remains secured on said lid to provide evidence that said latch has been released.

2. The closure in accordance with claim 1 in which said lid includes a slot; and said tamper-indicating element includes a peg protruding into said slot to guide the movement of said tamper-indicating element as said frangible portion breaks.

3. The closure in accordance with claim 1 in which said lid includes a cylindrical cavity; and said tamper-indicating element includes a cylindrical pivot post received in said cavity.

4. The closure in accordance with claim 2 in which said tamper-indicating element includes a projecting rib adjacent said locking lever.

5. The closure in accordance with claim 4 in which said lid includes a recess having a sloping surface adjacent said locking lever; and said rib includes a slanting cam surface for engaging and sliding up said recess sloping surface as said frangible portion breaks.

6. The closure in accordance with claim 1 in which said tamper-indicating element includes an extending tab defining an opening through which said locking lever projects.

7. The closure in accordance with claim 1 in which said tamper-indicating element has a distal end having a barb for piercing a seal and snagging packing material in the container.

8. The closure in accordance with claim 1 in which said closure further includes a hinge connecting said lid to said base.

9. The closure in accordance with claim 1 in which said tamper-indicating element attachment structure includes at least one post; and said lid includes a hole for receiving said post.

10. The closure in accordance with claim 1 in which said attachment structure includes (1) an anchor portion comprising (a) a plate having three regions, and (b) a post extending from said plate and engaged with said lid; and (2) a frangible portion attaching each said region of said plate to said removable part of said tamper-indicating element.

11. The closure in accordance with claim 10 in which said lid includes a bore;

said element removable part includes a hole;

said frangible portion includes three ribs which each extends radially inwardly from the periphery of said hole to connect with said plate at one of said regions; and said post is received in said lid bore, said post having an enlarged head preventing removal of said post from said lid bore, and said post and plate together defining said anchor portion that is retained on said lid before and after said frangible portion is broken.

12. The closure in accordance with claim 1 in which said tamper indicating element includes a graspable tab.

13. The closure in accordance with claim 1 in which said tamper indicating element has a notch defining a curved abutment surface for being engaged by said locking lever.

14. A tamper-evident closure for an opening to a container interior, said closure comprising:

a base for attachment to said container around said opening, said base having a deck including a discharge aperture for communicating with said opening;

a lid including a latch aperture and an adjacent latch surface;

a hinge for connecting said lid to said base in (1) a closed position wherein flow of the container-stored contents through the closure is occluded and (2) an open position away from said closed position permitting the dispensing of the container-stored contents from said discharge aperture;

a resilient locking lever that (1) is defined by said base, (2) projects from said deck through said latch aperture when said lid is closed, (3) is normally self-maintained in a locking position engaging said lid latch surface, and (4) is movable to a release position disengaged from said lid latch surface; and a tamper-indicating element that is mounted solely to said lid adjacent said lever and that is free of any attachment directly to said base, said tamper-indicating element including a removable part adjacent said locking lever and including an attachment structure that is engaged with said lid and that has a frangible portion which breaks when said locking lever is moved with sufficient force against said removable part of said tamper-indicating element to effect disengagement from said latch surface whereby a remaining part of said attachment structure remains on said lid to provide evidence that said lever was moved to said release position.

15. The closure in accordance with claim 14 in which said attachment structure includes a plate and a post projecting from said plate.

16. The closure in accordance with claim 14 in which said tamper-indicating element removable part includes a shank portion defining a hole; and said attachment structure includes (1) an anchor plate, (2) an anchor post extending from said plate and attached to said lid, and (3) a frangible portion connecting said plate to said removable part of said tamper-indicating element at the periphery of said holes.

17. The closure in accordance with claim 14 in which said tamper-indicating element is disposed along the top of said lid and extends from a location adjacent said locking lever to a location adjacent the periphery of said lid, said tamper-indicating element including an elongate portion having a distal end with a barb for piercing a seal and/or snagging packing material in said container, said barb resting on said lid to support said distal end of said tamper-indicating element on said lid.

18. A tamper-evident closure for an opening to a container interior, said closure comprising:

(1) a base for attachment to said container, said base including a discharge aperture, (2) a lid movable between a closed position occluding said discharge aperture and an open position spaced from said discharge aperture, and (3) a manually releasable latch defined cooperatively by a locking lever on said base and by said lid to hold said lid closed; and a tamper-indicating element that is separate from, but mounted solely to, said lid adjacent said latch, said tamper-indicating element being free of any attachment directly to said base, said tamper-indicating element having an extending tab defining an aperture for receiving said locking lever to block operational access to said locking lever and to prevent movement of said locking lever that would release said latch, said tamper-indicating element including a removable part containing said tab and including an attachment structure that is engaged with said lid and that has a frangible portion which breaks when sufficient force is applied to remove said removable part of said element from said lid to permit operation of said latch whereby the remaining part of said attachment structure remains on said lid to provide evidence that said removable part of said tamper-indicating element has been removed.

19. The closure in accordance with claim 18 in which said removable part of said tamper-indicating element has a distal end for piercing a seal and engaging and snagging packing material from said container.

* * * * *